US009520224B2

(12) United States Patent
McConkey

(10) Patent No.: US 9,520,224 B2
(45) Date of Patent: Dec. 13, 2016

(54) USE OF ALUMINA PAPER FOR STRAIN RELIEF AND ELECTRICAL INSULATION IN HIGH-TEMPERATURE COIL WINDINGS

(75) Inventor: Joshua S. McConkey, Orlando, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 674 days.

(21) Appl. No.: 13/585,399

(22) Filed: Aug. 14, 2012

(65) Prior Publication Data

US 2014/0049349 A1 Feb. 20, 2014

(51) Int. Cl.
*H01F 27/30* (2006.01)
*H01F 27/32* (2006.01)
*H01F 5/06* (2006.01)

(52) U.S. Cl.
CPC ..... *H01F 27/323* (2013.01); *H01F 5/06* (2013.01)

(58) Field of Classification Search
CPC ..... H01F 5/06
USPC ..... 336/196
See application file for complete search history.

(56) References Cited

U.S. PATENT DOCUMENTS 1,897,818 A * 2/1933 Paschen et al. ..... 336/90
2,008,859 A * 7/1935 Ganz ..... 332/180
2,533,716 A * 12/1950 Coursey ..... 361/301.5
3,510,363 A * 5/1970 Laessig et al. ..... 136/202
3,943,391 A 3/1976 Fehr
4,173,747 A * 11/1979 Grimes ..... H01F 27/322 336/206
4,918,801 A 4/1990 Schwarz
5,717,373 A 2/1998 Vachris
6,023,216 A * 2/2000 Gress ..... H01F 27/2871 336/185
6,629,344 B2 10/2003 Ringdahl
6,873,082 B2 3/2005 Neet
7,427,909 B2 9/2008 Ono
2002/0174963 A1* 11/2002 Wang ..... C04B 26/04 162/152
2006/0104881 A1* 5/2006 Lortz et al. ..... 423/335
2009/0121896 A1* 5/2009 Mitchell et al. ..... 340/870.31

FOREIGN PATENT DOCUMENTS

GB 1103764 A 2/1968
GB 1279615 A 6/1972
GB 1500484 A 2/1978
JP S5617006 A 2/1981
JP S5893315 6/1983

* cited by examiner

*Primary Examiner* — Mangtin Lian
*Assistant Examiner* — Ronald Hinson

(57) ABSTRACT

A coil (60). The coil (60) comprises a conductor formed in the shape of winding layers (68). The conductor comprises an insulating coating (96) surrounding a conductive core (94). The coil further comprises paper strips (80) disposed proximate one or more of the winding layers (68) to provide strain relief against mechanical forces exerted on the coil (60) and to provide electrical insulation between winding layers (68). In an embodiment where the coil (60) further comprises a core (70) the paper strips (80) are beneficially disposed at corners (70A, 70B, 70C, and 70D) of the core (70) and further between winding layers (68) at the corners (70A, 70B, 70C, 70D).

7 Claims, 3 Drawing Sheets

USE OF ALUMINA PAPER FOR STRAIN RELIEF AND ELECTRICAL INSULATION IN HIGH-TEMPERATURE COIL WINDINGS

FIELD OF THE INVENTION

This invention relates generally to gas turbines and more specifically to a rotating winding mounted within the gas turbine.

BACKGROUND OF THE INVENTION

A gas turbine, also called a combustion turbine, is a type of internal combustion engine including a rotating compressor coupled to a turbine. Ignition of a fuel in a combustion chamber disposed between the compressor and the turbine creates a high-pressure and high-velocity gas flow. The gas flow is directed to the turbine, causing it to rotate.

The combustion chamber comprises a ring of fuel injectors that direct fuel (typically kerosene, jet fuel, propane or natural gas) into the compressed air stream to ignite the air/fuel mixture. Ignition increases both the temperature and pressure of the air/fuel mixture (that is also referred to as a working gas).

The working gas expands as it enters the turbine. The turbine includes rows of stationary vanes and the rotating blades connected to a turbine shaft. The expanding gas flow is accelerated by the guide vanes and also directed over the turbine blades, causing the blades and thus the turbine shaft to spin. The spinning shaft both turns the compressor and provides a mechanical output. Energy can be extracted from the turbine in the form of shaft power, compressed air, thrust or any combination of these, for use in powering aircraft, trains, ships and electric generators.

BRIEF DESCRIPTION OF THE DRAWINGS

The invention is explained in the following description in view of the drawings that show.

DETAILED DESCRIPTION OF THE INVENTION

Figure 1:
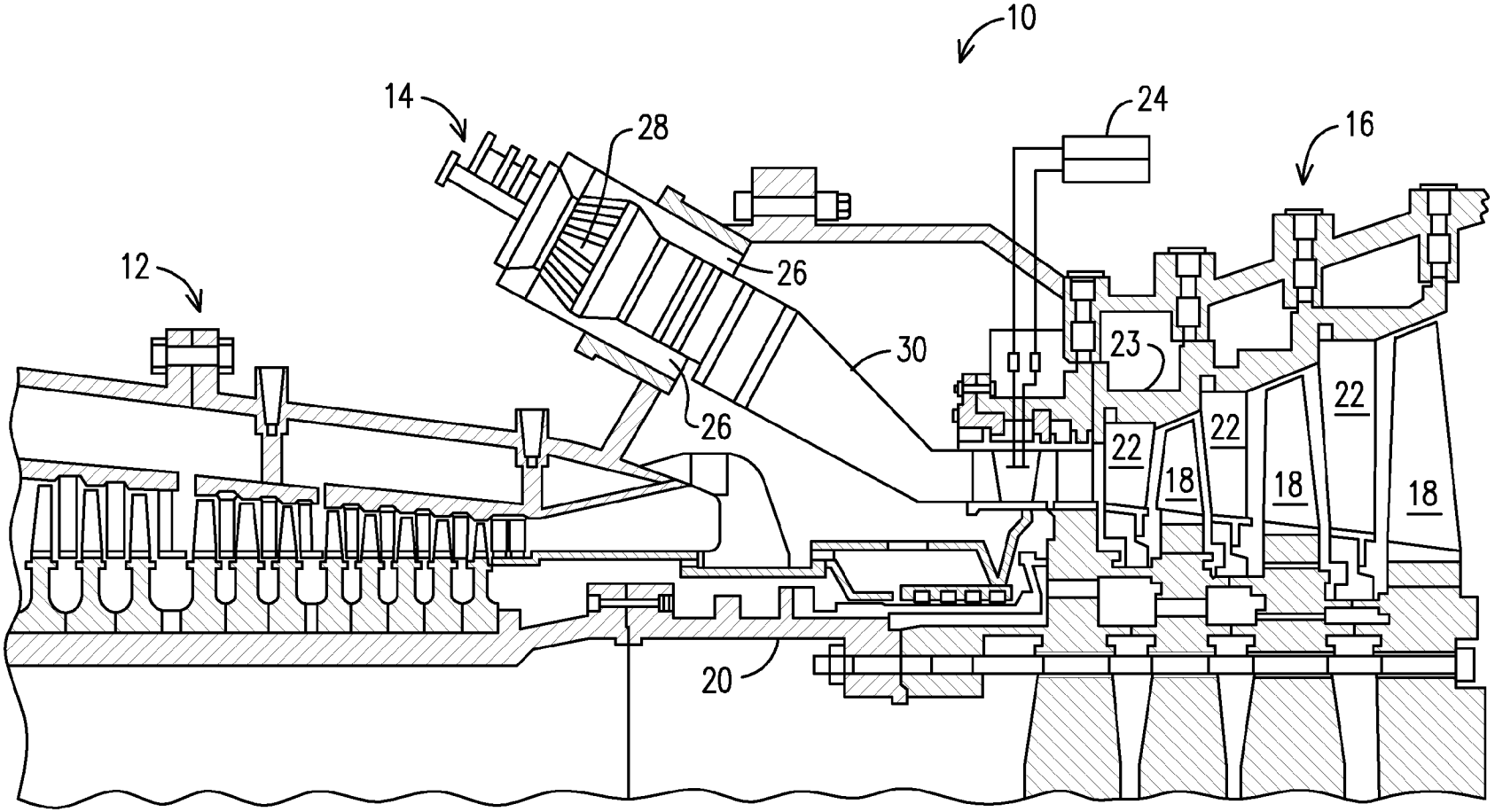
FIG. 1 PRIOR ART
FIG. 1 is an illustration of a prior art gas turbine suitable for use with the present invention.

FIG. 1 illustrates a cut away view of a combustion turbine 10, including a compressor 12, at least one combustor 14, and a turbine section 16. Typically, a plurality of combustors 14 is disposed in a circular arc around the turbine shaft. The turbine section 16 includes a plurality of rotating blades 18 secured to a rotatable central shaft 20. A plurality of stationary vanes 22 are positioned between the rotating blades 18 and are secured to turbine cylinder wall surfaces 23. The vanes 22 are dimensioned and configured to direct the working gas over the rotating blades 18.

In operation, air is drawn in through the compressor 12 where it is compressed and driven toward the combustor 14. The compressed air enters the combustor through an air intake 26. From the air intake 26, the air enters the combustor 14 at a combustor entrance 28 where it is mixed with fuel. The fuel/air mixture ignites to form the working gas. The working gas has a temperature range of between about 2,500 degrees F. and about 2,900 degrees F. (or between about 1,371 degrees C. and about 1,593 degrees C.). The working gas exits the combustor 14 and expands through a transition member 30 then through the turbine 16, being guided by the vanes 22 to drive the rotating blades 18. As the gas passes through the turbine 16 it rotates the blades 18 which, in turn, drive the shaft 20, thereby transmitting usable mechanical work through the shaft 20. The shaft 20 also turns a compressor shaft (not shown) to compress the input air.

In a gas turbine for generating electricity the shaft 20 further drives an electrical generator (not shown).

The combustion turbine 10 also includes an internal cooling system 24 for supplying a coolant, for example, steam or compressed air, to internally cool the blades 18, the vanes 22 and other turbine components.

It is critical to monitor operating parameters such as temperature and forces (e.g., stress and strain forces) within the turbine section of the gas turbine and especially at critical turbine structures such as the rotating blades and the stationary vanes. A sensing/instrumentation system monitors and measures these temperatures and forces. Incipient failures may be predicted and actual failures of internal gas turbine structures can be determined based on these temperature and force measurements.

Coil structures are used in one type of gas turbine sensing/instrumentation system. These coil structures must function continuously in the high temperature, high vibration, and high g-load environments inside the gas turbine.

The present invention teaches use of alumina paper as an electrical insulator and mechanical force-absorbing cushion in the coil structures. Alumina paper comprises aluminum dioxide ($AlO_2$) fibers or strands that retain the desired properties of high electrical resistance (i.e., desired insulation properties), and force-absorbing cushioning effect (i.e., aluminum dioxide does not become brittle) at the high operational temperatures within a gas turbine. Other materials that offer similar properties can be used in lieu of the alumina paper.

Figure 2:
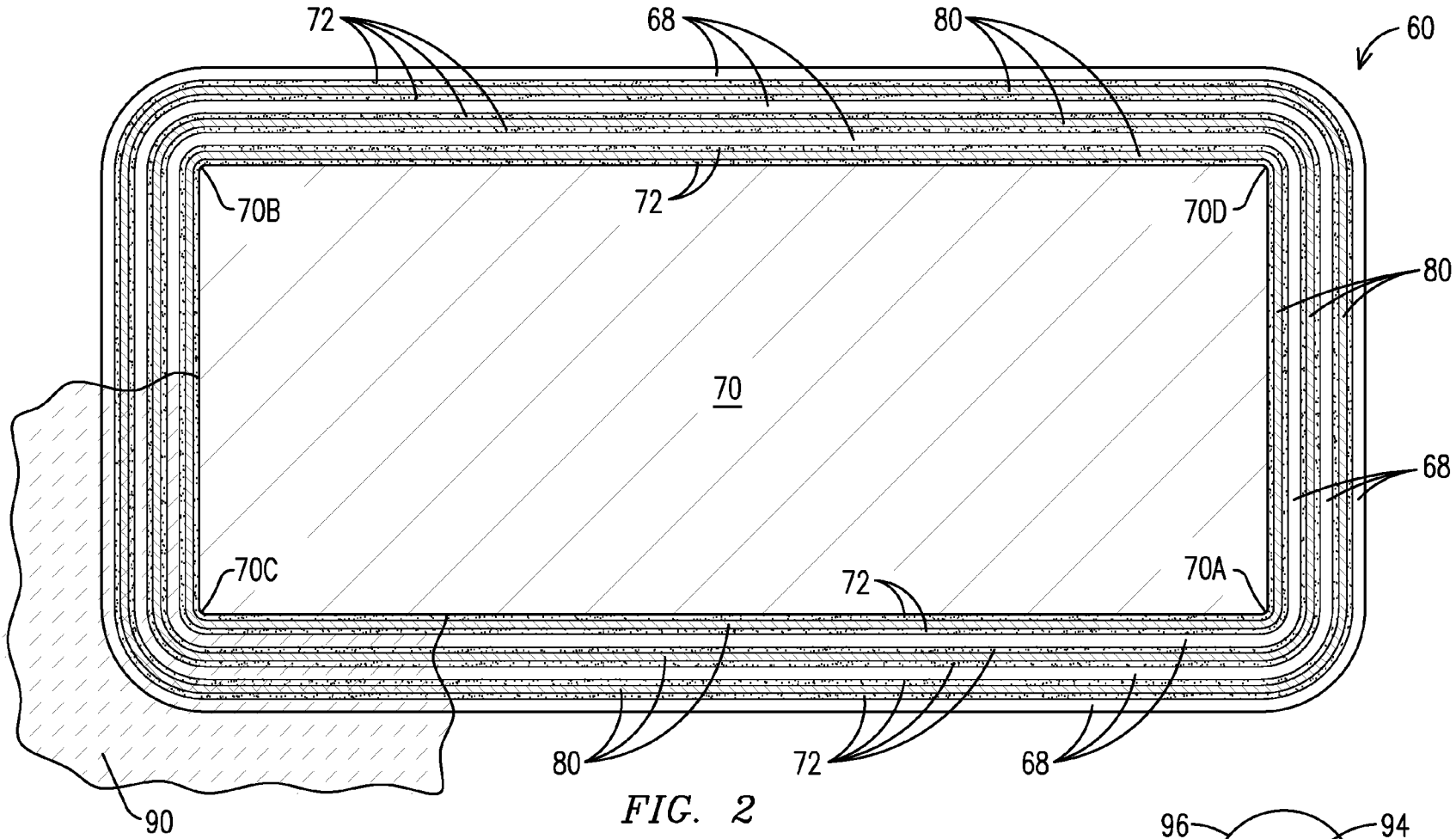
FIG. 2 is an illustration of a coil comprising insulated conductive windings for use in a sensing/instrumentation system disposed in a gas turbine.

Turning to FIG. 2, a coil 60 of the present invention comprises insulated conductive windings 68 (also referred to herein as conductors 68, wires 68 and winding layers 68) surrounding a magnetic core 70.

Figure 3:
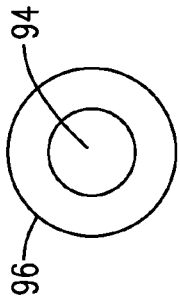
FIG. 3 is a cross-sectional illustration of a conductor for use in the coil of FIG. 2.

As illustrated in FIG. 3, the conductive windings 68 comprise a conductor 94 (such as nickel clad copper) surrounded by an insulating material jacket 96, such as ceramic.

The core 70 comprises a plurality of joined sheet steel laminations (which are not separately illustrated in FIG. 2).

In addition to the high forces experienced by the coil 60 the wide temperature range within the turbine (ranging from about 20 to about 450 degrees C.), causes significant thermal expansion and contraction in the windings 68 and in the core 70.

In an application where the coefficient of thermal expansion of the windings and the core are different (because they comprise different materials) thermal contraction and expansion problems are further exacerbated. The resulting thermal stresses and forces tend to force the windings 68 together or force the windings against the core 70.

The resulting flexing and rubbing of the windings 68 may destroy or at least compromise the efficacy of the insulation that surrounds the wires or windings 68. Such damage is especially likely where the windings 68 are bent, such as where the windings 68 pass over a corner of the core 70, e.g., corners 70A, 70B, 7C and 70D as shown in FIG. 2.

This degradation of the wire insulation severely degrades operation of the coil 60, which may have a major and critical impact on performance of the sensing/instrumentation system.

In addition to these thermally-induced forces, vibration of the windings 68 and the core 70 (caused by rotation of the gas turbine shaft) generates substantial additional forces on the windings 68 and the core 70.

To overcome the effects caused by these forces, alumina paper 80 (i.e., paper comprising aluminum oxide ($AlO_2$) fibers) is installed at one or more locations including, but not limited to: the interface between the windings 68 and the core 70, between layers of the insulated windings 68, and at corners 70A-70D of the core 70. Layers of ceramic adhesive 72 are applied between the core 70, the windings 68 and the alumina paper 80 as illustrated in FIG. 2.

In one embodiment the alumina paper 80 is disposed only at the corners 70A-70D of the core 70. In another embodiment the alumina paper 80 is disposed a the corners 70A-70D and between winding layers along the short ends of the core 70.

In particular at the corners 70A-70D the windings 68 are most likely to flex and therefore crack, degrading the insulation surrounding the windings 68 (the insulation surrounding the windings 68 is not shown in FIG. 2). Thus the alumina paper 80 is placed at least at the corners 70A-70D to obviate this problem.

Since the alumina paper 80 is flexible and exhibits considerable bulk and thickness, the paper 80 also serves as a strain relief and cushion for the windings 68, both between the windings 68 and at the interface between the windings 68 and the core 70 (and especially at the corners 70A-70D).

Since the alumina paper 80 is also a good electrical insulator, if the insulating material jacket 96 of FIG. 3 fails or is degraded, the alumina paper 80 provides an additional layer of insulation that can insulate the conductor 94 and thereby prevent short circuits.

The inventor has determined that the alumina paper 80 maintains these desired properties within the extreme temperature and high-force environment inside the gas turbine.

An insulating material 90 (e.g., a ceramic material shown generally in a cutaway section of FIG. 2) coats exposed surfaces of the windings 68 and exposed regions of the core 70 to provide additional thermal insulation for the windings 68 and the core 70. However, the insulating material 90 is brittle at the temperatures present in the gas turbine and therefore cannot provide cushioning or resilience against mechanical wear of the windings 68. Instead, the alumina paper 80 satisfies this requirement. The ceramic insulating material is also slightly conductive at the temperatures present in the gas turbine. Again, the alumina paper 80 avoids problems associated with this slight conductivity by providing the aforementioned insulating properties.

Figure 4:
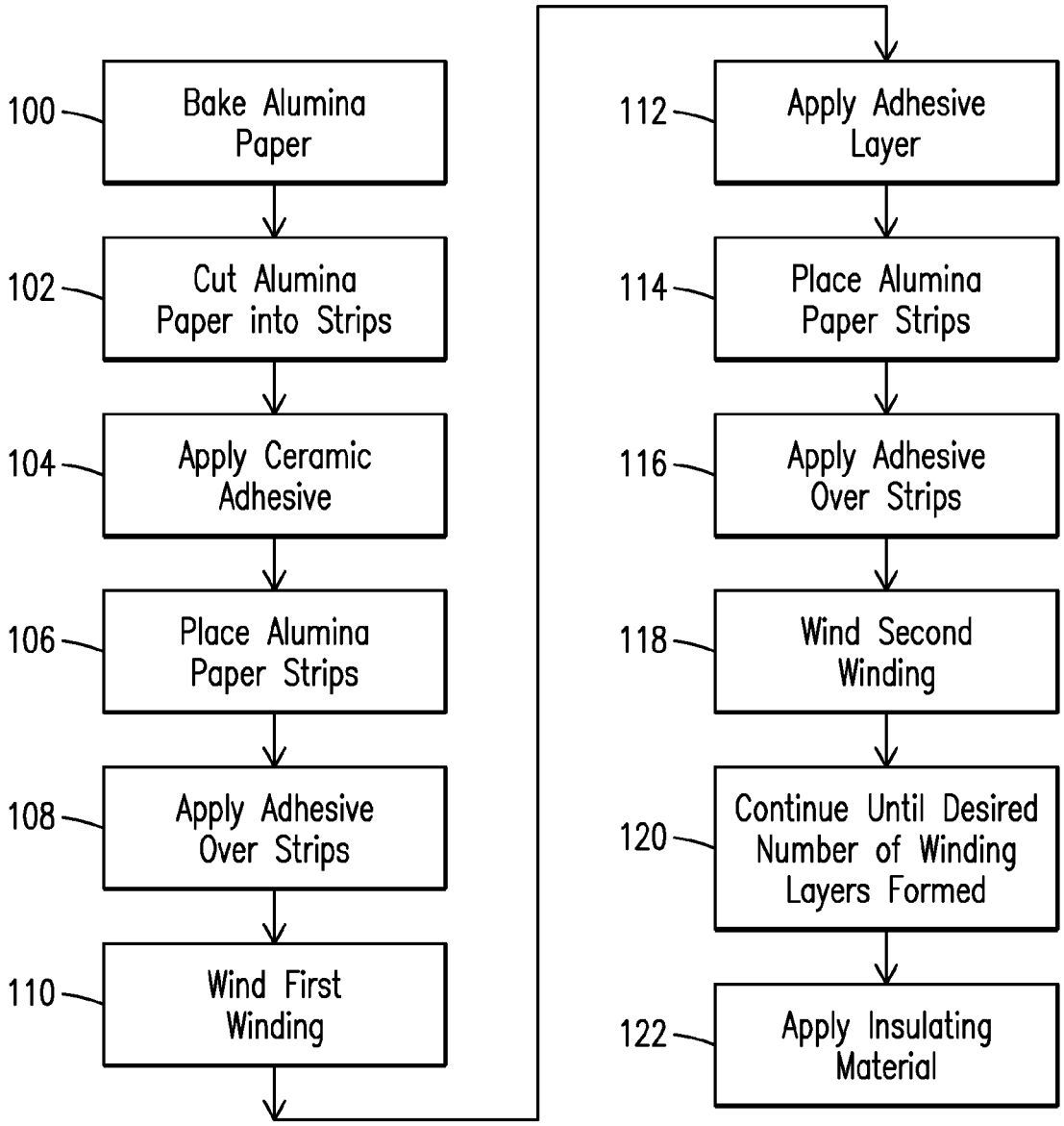
FIG. 4 is a depiction of one procedure for fabricating the coil of the present invention.

According to one embodiment of the invention, the coil 60 is formed according to the following procedure, which is depicted in FIG. 4.

1. Bake the alumina paper for about ten minutes at between about 500 and 600 degrees C. to ensure the paper is chemically inert. See a step 100 of FIG. 4. The alumina paper may change colors during the baking process, indicating that the paper has reached a chemically inert state.

2. Cut the alumina paper into strips of about 0.25 inches wide and about 0.7 inches long. The alumina paper is about 0.03 inches thick. See a step 102 of FIG. 4.

3. Apply a layer of ceramic adhesive along the corners 70A-70D (and along regions between the corners 70A-70D if desired) of the core 70. See a step 104 of FIG. 4.

4. Place the strips of the alumina paper over the ceramic adhesive while the adhesive is wet. See a step 106 of FIG. 4.

5. Apply a layer of ceramic adhesive over the alumina paper strips 80. See a step 108 of FIG. 4.

6. Wind a first winding layer over the adhesive strips/core assembly. See a step 110 of FIG. 4.

7. Apply another layer of ceramic adhesive. See a step 112 of FIG. 4.

8. Place the strips as desired (e.g., at corners of the core and/or between the corners) while the ceramic adhesive is still wet. See a step 114 of FIG. 4.

9. Apply a layer of ceramic adhesive over the adhesive strips. See a step 116 of FIG. 4.

10. Wind a second winding layer over the adhesive strips/core assembly. See a step 118 of FIG. 4.

11. Continue until a desired number of winding layers have been formed. See a step 120 of FIG. 4.

12. Apply the insulating material 90 over the entire assembly. See a step 122 of FIG. 4.

This described procedure may be varied according to different embodiments of the invention. For example, the assembly may be air-dried after various steps in the process, although this air-drying step is not required.

Preferably the insulating material 90 of comprises a ceramic potting material. The inventor has determined that the ceramic potting material and the alumina paper can survive up to temperatures of about 500 degrees C.

The teachings of the present invention are applicable to any coil (e.g., inductor, transformer, voltage transducer, of any inductance value) that must operate in a relatively high temperature environment with or without the presence of relatively high forces exerted on the coil windings during operation.

Although the present invention is described for a conventional rectangular core with windings wound around the core, the shape of the core is not pertinent to the present invention. The teachings apply to any core shape with the windings disposed over one or more of the core surfaces.

A winding as constructed according to the teachings of the present invention can operate in an environment of up to about 550 degrees C.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A coil comprising:

a conductor formed in the shape of winding layers, the conductor comprising an insulating coating surrounding a conductive core; and a coil core having a shape defining corners;

winding layers disposed around the coil core; and paper disposed between the winding layer adjacent the coil core and the coil core at the corners, and between winding layers, the paper comprising aluminum dioxide fibers or strands disposed between one or more of the winding layers to provide both strain relief against mechanical forces exerted on the coil and electrical insulation between winding layers at temperatures up to 550 degrees C.; and adhesive material, wherein the paper and the adhesive material are disposed between adjacent winding layers, wherein the adhesive material is disposed between an outer surface of the coil core and the paper.

2. The coil of claim 1 wherein the aluminum dioxide fibers or strands define dimensions of about 0.25 inches wide, about 0.7 inches long and about 0.03 inches thick.

3. The coil of claim 1 wherein the coil core comprises a rectangular coil core, the paper disposed between one or more of the winding layers along a short face of the coil core.

4. The coil of claim 3 wherein the paper is disposed between the winding layers at the corners of the rectangular coil core.

5. The coil of claim 1 further comprising a ceramic insulating material covering exposed surfaces of the winding layers and exposed regions of the coil core.

6. The coil of claim 1 further comprising a ceramic insulating material covering exposed surfaces of the windings and exposed regions of the coil core.

7. The coil of claim 1 wherein the conductive core comprises a nickel clad copper conductive core and the insulating coating comprises a ceramic insulating coating.

* * * * *